United States Patent [19]

Abbott

[11] Patent Number: 4,499,566

[45] Date of Patent: Feb. 12, 1985

[54] ELECTRO-CERAMIC STACK

[75] Inventor: Frank R. Abbott, San Diego, Calif.

[73] Assignee: The United States of America as represented by the Secretary of the Navy, Washington, D.C.

[21] Appl. No.: 226,668

[22] Filed: Jan. 21, 1981

[51] Int. Cl.[3] ..... H04R 17/00

[52] U.S. Cl. ..... 367/165; 367/155; 367/158; 310/337; 310/366

[58] Field of Search ..... 367/153, 155, 156, 157, 367/158, 159, 164, 165, 166, 167; 29/25.35; 310/365, 366, 337, 329, 328, 334, 363

[56] References Cited

U.S. PATENT DOCUMENTS

| | | | |
|---|---|---|---|
| 2,126,886 | 8/1938 | Hight | 367/158 |
| 2,139,469 | 12/1938 | Sachse | 310/363 |
| 2,728,869 | 12/1955 | Pohlman | 310/334 |
| 2,930,912 | 3/1960 | Miller | 367/157 |
| 3,100,291 | 8/1963 | Abbott | 367/152 |
| 3,215,977 | 11/1965 | Williams et al. | 367/158 |
| 3,258,738 | 6/1966 | Merchant | 367/158 |
| 3,337,843 | 8/1967 | Kendig et al. | 367/158 |
| 3,353,150 | 11/1967 | Jacox | 367/155 |
| 3,495,102 | 2/1970 | List et al. | 310/365 |
| 3,501,099 | 3/1970 | Benson | 310/328 |
| 3,673,442 | 6/1972 | Sonderegger | 310/329 |
| 4,035,761 | 7/1977 | Ehrlich | 367/158 |

FOREIGN PATENT DOCUMENTS

| | | | |
|---|---|---|---|
| 599830 | 6/1934 | Fed. Rep. of Germany | 367/153 |

OTHER PUBLICATIONS

Research Disclosure, Nov. 1979, Multilayered Piezolectric Flexure Device by Lee et al., pp. 627 and 628.

*Primary Examiner*—Harold J. Tudor

*Attorney, Agent, or Firm*—Robert F. Beers; Ervin F. Johnston; Thomas Glenn Keough

[57] ABSTRACT

A transducer of acoustic energy through a water medium is fabricated in a manner which assures high reliability yet significantly reduces cost per unit by including modified conductive elements. A pair of flat conductors are interleaved sinuously through a ferroelectric stack in a mutually orthogonal relationship. The conductors are so interleaved as to electrically couple the elements of the ferroelectric stack in parallel in accordance with proven transducer design. At least one rod axially extends through the sandwiched ferroelectric elements and conductors to hold them in compression and to assure a reliable electrical connection for producing an integral hydroacoustically cooperating structure.

1 Claim, 6 Drawing Figures

ELECTRO-CERAMIC STACK

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

The continuing evolution of hydroacoustic transducer design has resulted in the extensive use of ferroelectric elements functioning to project acoustic energy representative of driving potentials and to create representative signals when acoustic energy impinges on an appropriately impedance matched surface. Three evolving designs which reflect an advanced state of the art are shown by Frank R. Abbott in the patented embodiments of U.S. Patent and Trademark Office, No. 3,100,291; 3,700,939; and 3,718,897. These devices employ stacks of piezoelectric discs or ferroelectric rings as the driving-sensing elements in projectors or receivers of acoustic energy. The stacked elements are suitably polarized and have silver coated electrodes, thin leaf conductors and the like affixed to the ferroelectric elements with the whole lot being cemented and soldered together to unify the structure. This fabrication mode has worked well. The three designs identified above have functioned within and often exceeded their design expectations. However, all involved a rather laborious assembly procedure which tended to compromise their cost effectiveness. The disc-shaped and ring-shaped active elements were somewhat more expensive to make and, from time-to-time when high driving potentials were applied, the bonded stacks might damage themselves or pull apart from the conductor leaves and films.

Therefore, there is a continuing need in the state of the art for a hydroacoustic transducer which avoids a laborious fabrication procedure and its attendant costs.

SUMMARY OF THE INVENTION

The present invention is directed to providing an improved transducer and method of fabrication which assures the projection or reception of acoustic energy through a water medium. A stack of ferroelectric elements is polarized for axial deformation or to provide signals representative of impinging acoustic energy, when conductive means interposed between adjacent elements of the ferroelectric stack, either impress electric fields or pass the representative signals. A first conductive means is interposed between alternate elements of the ferroelectric stack and sinuously interleave the elements along the stack's length. A second conductive means is interposed between alternate elements of the ferroelectric stack and sinuously interleave the alternate elements of the ferroelectric stack along the stack's length. The first sinuously interleaving conducting means and the second sinuously interleaving conducting means are orthogonally disposed with respect to one another and the axis of the stack and are arranged to couple the ferroelectric elements electrically in parallel. A compressing means is coupled to opposite ends of the ferroelectric stack for holding the ferroelectric elements and first and second conductive means together to assure reliable operation.

The method of making the transducer involves the sinuous interleaving of a first conductive means between alternate elements of the ferroelectric stack along its length; the sinuously interleaving of a second conductive means between alternate elements of the ferroelectric stack orthogonally disposed with respect to the first conductive means and the axis of the stack along the length of the stack to couple the elements electrically in parallel; and compressing the ferroelectric stack and the first conductive means and the orthogonally disposed second conductive means assures a less laborious and cost effective method of construction. The first conductive means and the second conductive means are each fashioned from an integral strip of a conductive metal which is fabricated from a soft material such as lead that deforms under pressure to intimate contact with elements of the stack. Further forming the conductive metal strips with rounded edges reduces the possibility of corona and arcing.

A prime object of the invention is to provide an improved transducer and method of making same.

Yet another object is to provide a hydroacoustic transducer made from orthogonally disposed sinuously interleaved strips of conductive metal compressed by at least one rod which holds the conductors and their sandwiched ferroelectric elements together.

Yet another object is to provide a transducer fabrication technique that reduces the time and cost involved.

Still another object is to provide a hydroacoustic transducer and method of fabrication that invites the use of less expensive conductors and ferroelectric elements when compared to molded or pressed discs and rings.

A further object is to provide a pair of integral interleaved conductors that provide driving potentials for and representative signals from a ferroelectric stack.

Yet another object is to provide a transducer and method of fabrication which inherently protects the relatively fragile ferroelectric elements.

Still another object is to provide a transducer and method of making same which simplifies the fabrication procedure and permits a more efficient utilization of time.

These and other objects of the invention will become more readily apparent from the ensuing description and claims when taken with the drawings.

DESCRIPTION OF THE PREFERRED EMBODIMENT

Figure 1:
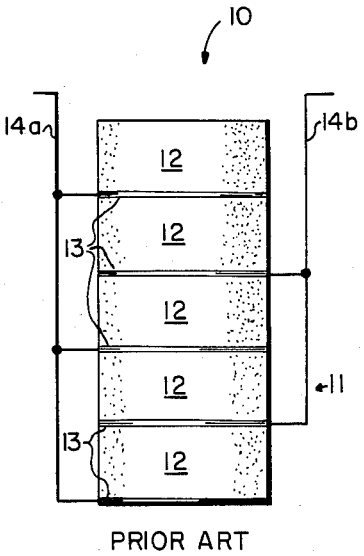
FIG. 1 depicts a state of the art transducer design having bonded, soldered electrically-in-parallel conductors sandwiched in a stack of ring-shaped ferroelectric elements.

Referring now to the prior art figure, FIG. 1 of the drawings, a typical electro-acoustic transducer 10 is schematically depicting having for example, a pair of acoustic energy radiating surfaces, not shown, mounted on opposite axial extremes of a ferroelectric stack 11. In accordance with contemporary design criteria, the ferroelectric stack is formed of a plurality of ring-shaped ferroelectric elements 12 sandwiching thin metal conductors 13 between adjacent elements of the stack.

The metal conductors are metal leaves bonded in place or, optionally, thin metal films coated on the ferroelectric rings. In either case they serve to impress electric fields across the ferroelectric elements or to transmit signals representative of impinging acoustic energy when the transducer functions as a hydrophone.

In either case, the ferroelectric rings were placed in a high-intensity polarizing electrical field directed substantially parallel to their axis. After assembly as a transducer, when a driving potential is fed to the metal conductors, the polarized ferroelectric rings impart a responsive bidirectional axial deformation or when used as a hydrophone they generate representative signals. The axial deformations or the representative signals of the individual rings are added together throughout the length of the stack to project high levels of acoustic energy or to provide a sensitive listening device. For these reasons, usually, flexible small diameter wires 14*a* and 14*b* are joined to alternate conductors to electrically couple the stack in parallel.

The wires are usually soldered to the conductors and care must be taken that the connection is secure enough to withstand the vibrations, heat etc. attendant operation of the transducer. In this regard the rigid soldered connections have proven themselves to be less reliable than needed under certain applications. The fabrication steps involved in applying a conductive coating or a conductive leaf between adjacent conductors, cementing this together, soldering parallel wires to the thin metal conductors and polarizing the stack have been a laborious time consuming procedure.

Figure 2:
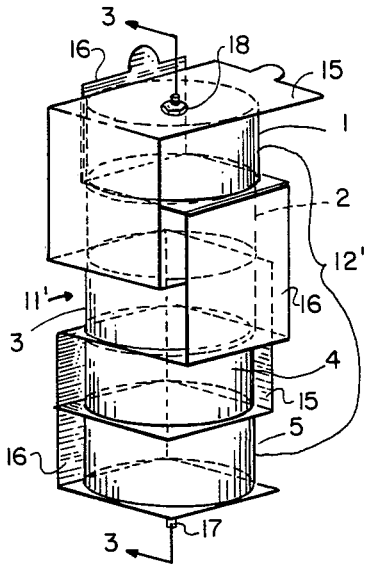
FIG. 2 is an isometric depiction of the inventive concept of the invention showing the mutually orthogonally disposed sinuously interleaved conductive means and disc-shaped ferroelectric elements.

The improvement to transducer design is depicted in FIG. 2 where a ferroelectric stack 11' includes a number of ferroelectric elements 12'. In this regard, because of the improved fabrication disclosed and claimed herein, the ferroelectric elements optionally are either circular 12' ring shaped 12'', see FIG. 3 or rectangularly shaped 12''', see FIG. 4.

A thin metal strip 15 and 16 of a conductive material such as soft lead and the like is sinuously interleaved in a serpentine or wavy form between alternate ones of the ferroelectric elements to electrically couple them in parallel. Referring again to FIG. 3 conductive metal strip 16 is placed between elements 1 and 2 and between elements 3 and 4 and between element 5 and a lower end cap 19. The other conductive metal strip 15 similarly sinuously interleaves the stack of elements by being placed between top and cap 19 and element 1, passing between elements 2 and elements 3 and between elements 4 and elements 5. It is noted that the two conductive strips are offset one from the other by one ferroelectric element. The two strips are interleaved with respect to each other in an orthogonal relationship to jut out at right angles with respect to each other.

After the conductors have been so interleaved, a threaded rod 17 is inserted through the stack of elements and sandwiched conductors and, after a nut 18 is tightened, the whole works is held in compression. Of course, holes are provided in the conductorsfor the passage of the rods. This compressive holding secures the lot together and assures that electrical contact is made between the metal strips and the ferroelectric elements.

Figure 3:
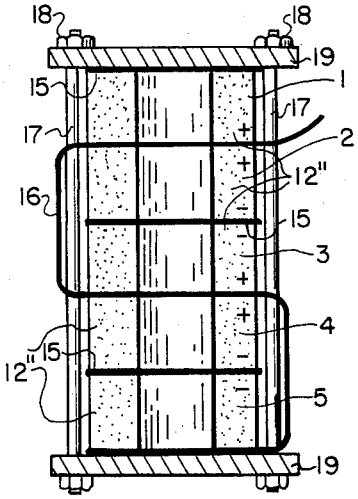
FIG. 3 is a cross-sectional view of the invention taken generally along lines 3—3 in FIG. 2 having ring-shaped instead of disc shaped elements.
Figure 4:
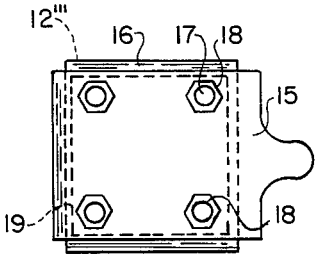
FIG. 4 is a top view of the invention showing the use of square or rectangularly-shaped ferroelectric blocks.

Alternately, if ferroelectric discs are used instead of rings, two to four compressional rods 17 can be used preferably at each corner with proper clearance from the sinuous or serpertine strips, see FIGS. 3 and 4. When the rods and strips are so arranged the rods are nonconductive or are provided with insulative sheaths, not shown, to prevent corona.

Figure 5A:
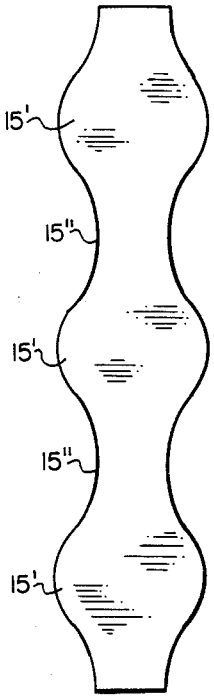
FIGS. 5*a* and 5*b* are modifications of elements.
Figure 5B:
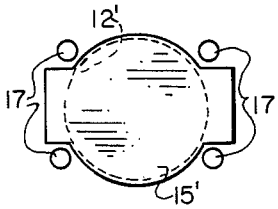

A modification of a strip 15' appears in FIG. 5*a*. This embodiment preforms the strip with notches 15'' to allow the rods to lie closer to the edges of the ferroelectric discs, see FIG. 5*b*.

Figure 6:
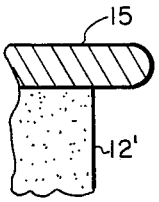
FIG. 6 depicts a rounded edge of a metal strip.

The metal strips inherently provide several protections for the stack. There is an improved reliability because there is no longer the danger of breaking any soldered connections nor chipping of the blocks. The rounded edges of the metal strips permit higher voltage operation and reduces the possibility of creating corona and sparks to achieve better utilization of the ceramic material (see FIG. 6). This manner of fabrication permits the use of rectangular blocks which are cheaper than the more costly molded or pressed disc-shaped and ring-shaped ferroelectric elements.

End caps 19 optionally are provided to further protect the stack and to more evenly distribute the compressive force. The compressive force is increased to assure intimate contact between the lead strips and the ferroelectric elements and polarization of the ferroelectric elements proceeds after the burrs or sharp edges of the strip are removed by acid dip or otherwise.

Obviously, many modifications and variations of the present invention are possible in the light of the above teachings. It is therefore to be understood that within the scope of the appended claims the invention may be practiced otherwise than as specifically described.

I claim:

1. In a transducer for projecting or receiving energy through a water medium including a stack of axially ferroelectric elements each having two parallel faces polarized for axial deformation or to provide signals representative of impinging acoustic energy, an improvement is provided in the conductors interposed between abutting pairs of the parallel faces of adjacent axially aligned elements that impress electric fields and pass the representative signals comprising:

a first integral, one-piece conductor fabricated from a soft lead conductive material that deforms when interposed between every other pair of abutting faces of the axially aligned ferroelectric stack shaped in a sinuous cross-sectional configuration for sinuously interleaving and intimately contacting abutting faces of every other pair of abutting faces of the axially aligned elements the length of the stack;

a second integral, one-piece conductor fabricated from a soft lead conductive material that deforms when interposed between every other pair of abutting faces of the axially aligned ferroelectric stack that are offset one element from the elements that the first integral one-piece conductor is interposed between and shaped in a sinous cross-sectional configuration for sinuously interleaving and intimately contacting abutting faces of every other pair of abutting faces of the axially aligned elements the length of the stack, the first sinuously interleaving integral one-piece conductor and the second sinuously interleaving integral one-piece conductor being orthogonally disposed with respect to one another and the axis of the stack and arranged in a contacting relationship with the axially aligned elements to couple the axially aligned elements electrically in parallel, the integral strips of conductive material are formed with round edges to reduce the possibility of corona and arcing;

end caps on opposite ends of the ferroelectric stack; and at least one nonconductive rod coupled to the end caps to exert a compressive force on the stack and integral strips of conductive material for compressing the elements and the first sinuously interleaving integral, one-piece conductor and the orthogonally disposed second sinuously interleaving integral, one-piece conductor.

* * * * *